United States Patent [19]

Ishima et al.

[11] Patent Number: 4,872,842

[45] Date of Patent: Oct. 10, 1989

[54] ELECTRIC CONNECTING DEVICE

[75] Inventors: Tsutomu Ishima, Utsunomiya; Kinihiko Sasaki, Miyagi, both of Japan

[73] Assignees: Alps Electric Co., Ltd.; Honda Motor Co., Ltd., both of Japan

[21] Appl. No.: 265,119

[22] Filed: Oct. 31, 1988

[30] Foreign Application Priority Data

Nov. 4, 1987 [JP] Japan ..... 62-167859

[51] Int. Cl.[4] ..... H01R 35/00

[52] U.S. Cl. ..... 439/15

[58] Field of Search ..... 439/11, 13, 15

[56] References Cited

U.S. PATENT DOCUMENTS 4,660,500 4/1987 Zeller et al. ..... 116/31
4,735,573 4/1988 Zeller et al. ..... 439/15
4,789,342 12/1988 Shitanoki ..... 439/15

*Primary Examiner*—Gary F. Paumen
*Attorney, Agent, or Firm*—Guy W. Shoup; Paul J. Winters; Stephen L. Malaska

[57] ABSTRACT

An electric connecting device wherein a movable member can be locked with certainty with respect to a fixed member and the safety is assured even if such a locking mechanism is not removed. The electric connecting device comprises a resilient member removably mounted on one of the fixed member and the movable member for engaging with the other of the fixed member and the movable member. The movable member is thus normally held at its home position with respect to the fixed member by the resilient member, and after the electric connecting device is assembled to a predetermined device, the resilient member is removed. Even if the resilient member is otherwise left on the electric connecting device, it will not make an obstacle to rotation of the movable member.

3 Claims, 3 Drawing Sheets

ELECTRIC CONNECTING DEVICE

BACKGROUND OF THE INVENTION

1. Field of the invention

This invention relates to an electric connecting device wherein electric connection between a fixed member and a movable member mounted for rotation relative to the fixed member is established by means of a cable such as a flat cable.

2. Description of the Prior Art

An electric connecting device for electrically connecting a fixed member and a movable member to each other is used, for example, for a steering wheel of an automobile. In such an arrangement, it is necessary to mount the electric connecting device such that the movable member can be rotated by a substantially equal amount in the opposite directions from a neutral position of the steering wheel. An electric connecting device which is conventionally used is provided with a mechanism which presents an index for positioning between a fixed member and a movable member in order to attain such rotational movement of the movable member as described above. A conventional positioning mechanism of the type mentioned normally includes a rotatable member provided on either the fixed member or the movable member and having a gear thereon, and an engaging member provided on the other member for engaging with the gear of the rotatable member. Each time the movable member makes one rotation, the gear is engaged with and rotated by a predetermined angle by the engaging member. Accordingly, when a particular tooth of the gear is positioned at a predetermined position and the movable member is positioned at a predetermined position with respect to the fixed member, the steering wheel assumes its neutral position. Thus, a mark is applied to the particular tooth of the gear and also to a member on which the gear is supported while a mark is applied to both of the movable member and the fixed member, and in assembling the electric connecting device to an appliance, the marks are positioned in a mutually aligned relationship in order to assemble the electric connecting device in a condition wherein the movable member assumes its neutral position with respect to the fixed member.

An electric connecting device is also known wherein a clip member is provided on a locking member mounted on a rotatable member. The clip member is engaged by a snap action with an engaging portion formed on a fixed member in order to hold a movable member at its neutral position with respect to the fixed member before an assembly composed of the movable member and the fixed member is assembled to a predetermined appliance, and after completion of the assembly to the appliance, the locking member is removed from the fixed member.

By the way, such a locking member as mentioned above is formed from a hard material such as a plastic material. Accordingly, if the locking member is left in engagement with the fixed member after assembly of the electric connecting device to the appliance, then the movable member cannot be rotated. In such an instance, if the movable member is forced to rotate after assembly, a portion of the fixed member remaining in engagement with the locking member may be broken, causing a fragment of the fixed member to remain within the casing and to make undesirable noises upon driving of the automobile.

Further, in assembling the above described electric connecting device to an appliance, it may be mounted and removed several times repetitively due to a relationship thereof to some other members which are to be assembled together with the electric connecting device. It is cumbersome, however, to mount and remove the locking member each time the electric connecting device is mounted and removed. Therefore, after the locking member is once removed, a re-mounting operation is conducted without re-mounting the locking first member. Accordingly, even if the movable member is assembled while it is positioned accurately with respect to the fixed member upon re-mounting of the locking member after removal, there is the possibility that the movable member may be displaced out of position in the course of assembly. Also there is a drawback that the ease of assembly is low.

SUMMARY OF THE INVENTION

Accordingly, it is an object of the present invention to provide an electric connecting device wherein a movable member can be locked with certainty with respect to a fixed member even if such a locking mechanism is not removed.

In order to attain the object according to the present invention, there is provided an electric connecting device which comprises a fixed member, a movable member mounted for rotation on the fixed member, a cable for electrically connecting the fixed member and the movable member to each other, a rotational position detector provided between the fixed member and the movable member and including a gear which is rotated by a predetermined angle each time the rotational member is rotated for one full rotation. The rotational position detector detecting a rotational position of the movable member in accordance with a position of a tooth of the gear, and a resilient member removably mounted on either the fixed member or the movable member for engaging with the other of the fixed member and the movable member.

With the electric connecting device, if it is assembled in an assembling step to a predetermined appliance together with the resilient member while the movable member is positioned at the predetermined home position with respect to the fixed member, then it can be assembled with the movable member maintained at its home position without fail. Further, when the electric connecting device is to be re-mounted on the appliance after it has been once assembled to and then removed from the appliance, if the movable member is adjusted to the home position with respect to the fixed member and then the electric connecting device is re- mounted on the appliance, then there is no possibility that the movable member may be displaced out of position in the course of assembly of the electric connecting device.

Further, while the resilient member is fixed with the movable member positioned at the predetermined position with respect to the fixed member, the movable member can be rotated in the mounted condition of the resilient member. Accordingly, even if the resilient member is left in the mounted condition without being removed, it will not prevent rotation of the movable member. Thus, if the electric connecting device is used for a steering wheel of an automobile, it is safe, and the resilient member will be dropped during operation of the electric connecting device. Besides, even if the resilient member is put between adjacent turns of the flat cable, there is no possibility that the flat cable may be damaged or broken by the resilient member.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
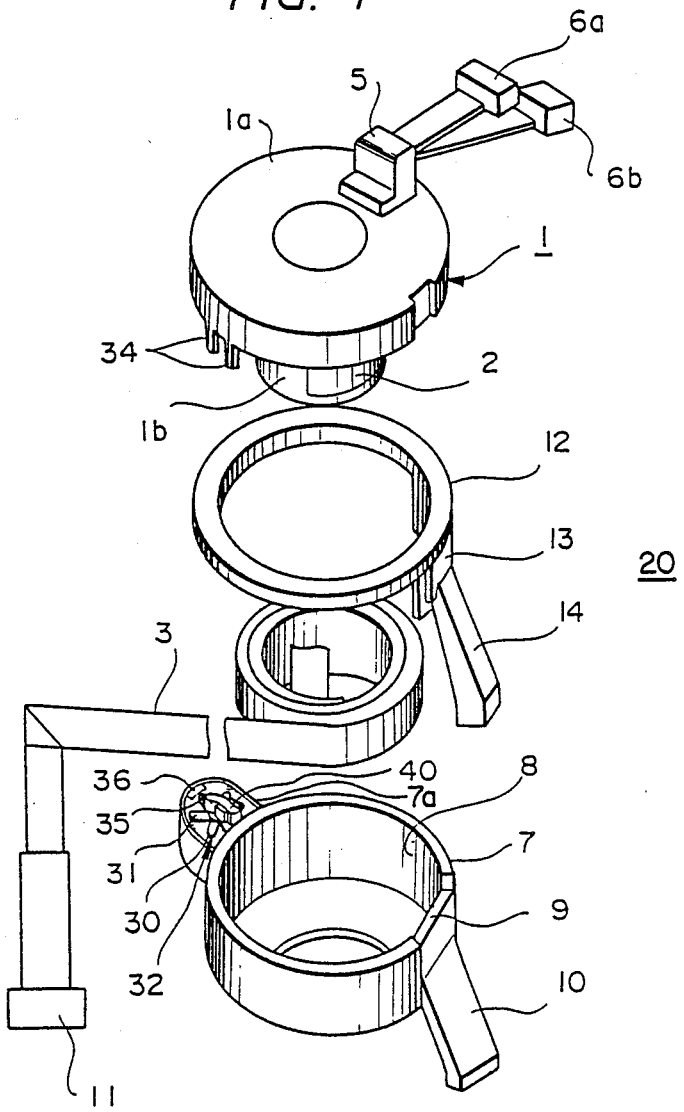
FIG. 1 is a fragmentary perspective view of an electric connecting device showing a preferred embodiment of the present invention.

Referring first to FIG. 1, an electric connecting device 20 according to the present invention includes a movable member 1 which is composed of an upper greater diameter portion 1*a* and a smaller diameter portion 1*b* extending downwardly from a bottom face of the greater diameter portion 1*a*. A partition wall 2 is formed contiguously on the greater diameter portion 1*a* such that it may oppose an outer circumferential face of the smaller diameter portion 1*b* by a predetermined distance. A flexible flat cable 3 having conductor foil wires enclosed therein is secured at an end thereof between the partition wall 2 and the outer circumferential face of the smaller diameter portion 1*b*. Meanwhile, a cable lead out portion 5 is provided at an upper face of the greater diameter portion 1*a* of the movable member 1, and a pair of connectors 6*a* and 6*b* are provided at ends of a pair of cables led out from the leading out portion 5.

The electric connecting device 20 further includes a fixed member 7 which has an accommodating spacing 8 formed therein for accommodating the smaller diameter portion 1*b* of the movable member 1 and the flat cable 3 therein. The fixed member 7 further has a recess 9 formed at an upper portion thereof for leading out the flat cable 3 therethrough. A guide portion or projection 10 is formed at and extends downwardly from a location of the fixed member 7 below the recess 9 so that the flat cable 3 may be led out downwardly through the recess 9 and along the guide portion 10. A connector 11 is provided at the other end of the flat cable 3.

A ring member 12 is interposed between the movable member 1 and the fixed member 7. An engaging portion 13 is formed in a contiguous relationship on the ring member 12 and fitted in the recess 9 of the fixed member 7 such that it may be held between the opposite end portions of the annular wall of the fixed member 7 on the opposite sides of the recess 9. A cable hold down portion 14 is formed adjacent the engaging portion 13 on the ring member 12 and extends in an opposing relationship to the guide portion 10 of the fixed member 7.

Figure 2:
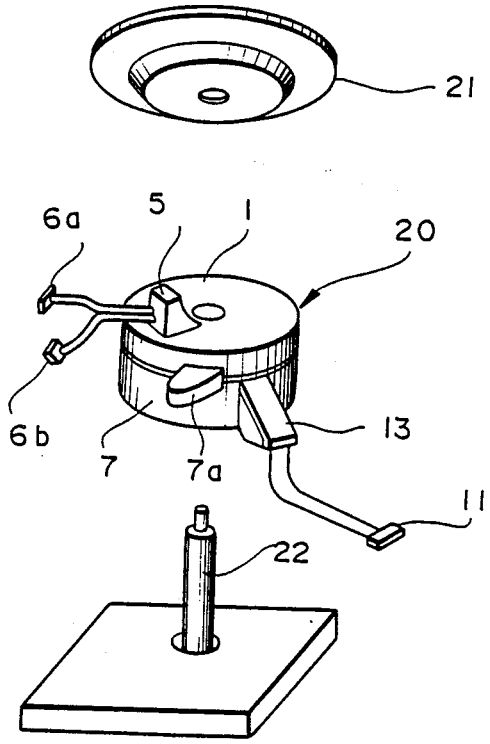
FIG. 2 is a fragmentary perspective view illustrating the electric connecting device of FIG. 1 being assembled to a steering wheel of an automobile.

The electric connecting device 20 has such a general construction as described above and is assembled, for example, in such a manner as shown in FIG. 2 wherein it is connected to a steering wheel 21 and a steering shaft 22 of an automobile. Where the electric connecting device 20 is assembled in this condition, the movable member 1 must be rotated substantially by an equal amount whether it is rotated in one direction or in the other direction from its neutral position.

Figure 3:
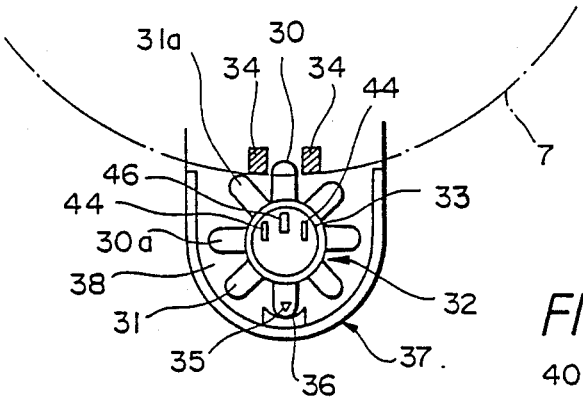
FIG. 3 is a plan view showing a rotational detector of the electric connecting device of FIG. 1.

In order to permit the movable member 1 to be assembled in an appropriate condition with respect to the fixed member 7, the fixed member 7 has an extension 7*a* which extends in a radially outward direction therefrom. A rotary member 32 is supported for rotation on a support shaft 33 provided uprightly on the extension 7*a* of the fixed member 7. Referring to FIG. 3, the rotary member 32 includes a first gear 30 having four teeth 30*a* formed in a spaced relationship by an angle of 90 degrees thereon,and a second gear 31 similarly having four teeth 31*a* formed in a spaced relationship by an angle of 90 degrees thereon and secured to the first gear 30 such that the teeth 31*a* thereon may be displaced by an angle of 45 degrees from the teeth 30*a* of the first gear 30. On the other hand, a pair of engaging rods 34 are formed on and extend downwardly from the bottom face of the greater diameter portion 1*a* of the movable member 1. The engaging rods 34 are spaced from each other by a distance a little greater than the width of the teeth 30*1* and 30*b* of the first and second gears 30 and 31 so that a gear tooth 30*a* or 30*b* may be fitted between them. Thus, when the movable member 1 is rotated one full rotation relative to the fixed member 7, the rotary member 32 is angularly rotated by an angle of 90 degrees by an action of the engaging members 34. A positioning mark 35 is formed by coloring or some other means on a specific one of the teeth 30*a* of the gear 30 of the rotary member 32 which overlies the gear 31. Another mark 36 with which the mark 35 is to be aligned is provided at a predetermined location of the extension 7*a* of the fixed member 7. Thus, a rotational position detector 37 is formed which can achieve rough positioning of the movable member 1 relative to the fixed member 7.

Here, even if the movable member 1 is operated to align the mark 35 with the mark 36, the position thereof still includes an error corresponding to one complete rotation thereof. Accordingly, it is necessary to adjust the movable member 1, after such alignment of the mark 35 with the mark 36, so that the movable member 1 may assume its neutral position with respect to the fixed member 7 with a higher degree of accuracy.

Figure 4:
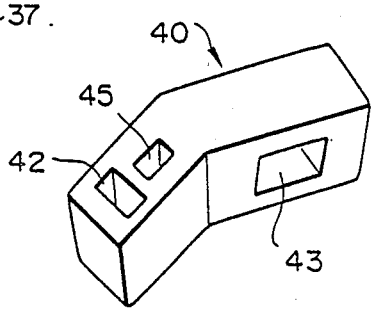
FIG. 4 is a perspective view showing an appearance of a click member of the electric connecting device of FIG. 1.
Figure 5:
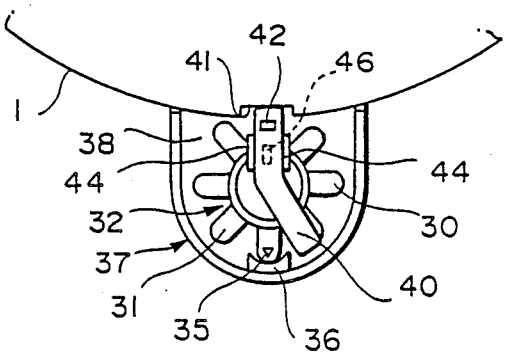
FIG. 5 is a plan view showing the click member of FIG. 4 in an assembled condition.

Accordingly, a mechanism is provided for adjusting the position of the movable member 1 within one full rotation with respect to the fixed member 7. The mechanism is composed of a click member 40 serving as a resilient member made of soft rubber or the like and mounted above the rotational detector 37 on the extension 7*a* of the movable member 7, and a click recess 41 formed on an outer wall of the greater diameter portion 1*a* of the movable member 1. Referring to FIG. 4, the click member 40 has a perforation 42 formed at an end portion thereof for permitting the movable member 1 to be rotated against a comparatively low resistance and for permitting the click member 40 to be deformed readily when the click member 40 is moved from the click recess 41. The click member 40 further has an engaging hole 43 perforated at the other end portion thereof for engaging with a jig for removing the click member 40. The click member 40 still further has an engaging hole 45. Meanwhile, a pair of engaging bars 44 and a projector 46 are provided uprightly on a window 38 for indication of the rotational detector 37, and the click member 40 is temporarily positioned in a condition wherein it is held between the engaging bars 44. In this time, an engaging hold 45 of the click member engages the projector 46. Accordingly, the click member 40 can be removed comparatively readily. The click member 40 is formed as seen in FIG. 5 in order that, when the click member 40 is mounted, the mark 35 provided on the specific tooth 30*a* of the rotational detector 37 may be observed from outside.

The electric connecting device of the present embodiment has such a construction as described above, and in the following, assembling operation of the same is will be described.

At first, the movable member 1 is assembled to the fixed member 7 with the flat cable 3 and so on received in the accommodating portion 8 of the fixed member 7, and the click member 40 is mounted between the engaging bars 44. After completion of such assembly, the movable member 1 is rotated until the mark 35 provided on the specific tooth 30*a* of the first gear 30 is aligned with the mark 36 provided on the extension 7*a* of the fixed member 7, and after that, the movable 1 is rotated until the click member 40 is fitted into the click recess 41 of the movable member 1. In this position, the movable member 1 is positioned accurately at its neutral position. If a force of a certain magnitude is applied to the movable member 1, then the click member 40 is resiliently and yieldably deformed to permit rotation of the movable member 1, but in a normal condition, the click member 40 is engaged with the click recess 41 of the movable member 1 to hold the movable member 1 from moving inadvertently from its neutral position. Accordingly, the movable member 1 is not rotated inadvertently with respect to the fixed member 7 during transportation or the like of the electric connecting device, and consequently the movable member 1 can be assembled to an appliance such as a steering wheel as it is.

By the way, sometimes it becomes necessary to remove the electric connecting device from the appliance after the movable member 1 has been suitably rotated once after assembly of the electric connecting device to the appliance as described above. In such an instance, the movable member 1 may possibly be positioned at a position other than the neutral position. Accordingly, the movable member 1 must be adjusted so as to assume its neutral position. Thus, at first the movable member 1 is rotated by manual operation thereof until the mark 35 provided on the specific tooth 30*a* of the first gear 30 is aligned with the mark 36 provided on the extension 7*a* of the fixed member 7. Here, since the click member 40 is formed from a resilient material, when the movable member 1 is rotated, the click member 40 is slidably contacted with a side face of the movable member 1, and when it is fitted into or moved from the click recess 41 of the movable member 1, it does not provide a high resistance. Further, while such alignment is reached under observation of the marks 35 and 36, since the click member 40 is disposed above the window 38 for indication of the rotational detector 37, it will not prevent observation of the position of the mark 35 in the thus aligned condition with the mark 36.

If the movable member 1 is rotated by a predetermined amount in either direction after the alignment between the marks 36 and 36 has been reached in such a manner as described above, the click member 40 will be engaged with the click recess 41 of the movable member 1. Upon such engagement, a click feeling is transmitted to a hand which makes a rotating operation of the movable member 1 so that it can be confirmed that the movable member 1 is positioned accurately at its neutral position. Since confirmation by observation is required only for alignment between the marks 35 and 36, positioning of the movable member 1 to its neutral position can be simplified extremely, and the accuracy in the operation can be anticipated. Further, after such adjustment of the movable member 1 to the neutral position has been made, the thus temporarily positioned condition is maintained by engaging relationship between the click member 40 and the click recess 41 of the movable member 1. Accordingly, the movable member 1 will not be moved out of position when the electric connecting device 20 is assembled to an appliance such as a steering wheel.

After the final assembly is completed in such a manner as described above, the click member 40 is removed from the engaging bars 44. In this instance, if a suitable jig is engaged with the engaging hole 43 of the click member 40 and then pulled, then the click member 40 can be removed readily from the engaging bars 44. To the contrary, even if the click member 40 is left fitted between the engaging bars 44 without being removed, it will not substantially prevent rotation of the movable member 1 because it is made of a resilient material. Or otherwise, the click member 40 may be removed naturally during use of the appliance. Even if the click member 40 is dropped from the engaging bars 44 in this manner and put between adjacent turns of the flat cable 3, it will not damage or break the conductor lines of the cable 3.

As apparent from the foregoing description, according to the present invention, an electric connecting device is constituted such that a movable member is positioned with respect to a fixed member by means of a resilient member interposed between the movable member and the fixed member. Accordingly, various effects can be anticipated. In particular, the electric connecting device can be assembled to a predetermined appliance while the movable member is held at its predetermined home position with certainty, and positioning of the movable member upon re-mounting after it has been assembled once can be made in a stable condition. Further, even if the resilient member is left in position without being removed after the electric connecting device has been assembled in position, it will not make an obstacle to rotation of the movable member.

Having now fully described the invention, it will be apparent to one of ordinary skill in the art that many changes and modifications can be made thereto without departing from the spirit and scope of the invention as set forth herein.

What is claimed is:

1. An electric connecting device, comprising a fixed member, a movable member mounted for rotation on said fixed member, a cable for electrically connecting said fixed member and said movable member to each other, a rotational position detector provided between said fixed member and said movable member and including a gear which is rotated by a predetermined angle each time said rotatable member is rotated for one full rotation, said rotational position detector detecting a rotational position of said movable member in accordance with a position of a tooth of said gear, and a resilient member removably mounted on said rotational position detector for engaging with said movable member to facilitate precise positioning of said movable member relative to said fixed member.

2. An electric connecting device according to claim 1, wherein the other of said fixed member and said movable member has a click recess formed on a wall thereof such that, when said movable member is in its home position, said resilient member may be engaged with said click recess.

3. An electric connecting device according to claim 1, wherein said rotational position detector including said gear is provided on said fixed member while said resilient member is disposed on an indicating section of said rotational position detector, and said resilient member has a bent portion which is bent such that it may expose a home position indicating portion of said indicating section, said resilient member further having an engaging portion formed at said bent portion thereof for being engaged by a jig for removal of said resilient member.

* * * * *